United States Patent [19]

Morita

[11] 4,421,046

[45] Dec. 20, 1983

[54] THREAD CUTTER ASSEMBLY IN SEWING MACHINE

[75] Inventor: Minoru Morita, Nagoya, Japan

[73] Assignee: Mitsubishi Denki Kabushiki Kaisha, Tokyo, Japan

[21] Appl. No.: 236,413

[22] Filed: Feb. 20, 1981

[30] Foreign Application Priority Data

Feb. 21, 1980 [JP] Japan ..... 55-20857
Nov. 21, 1980 [JP] Japan ..... 55-164864

[51] Int. Cl.[3] ..... D05B 65/00
[52] U.S. Cl. ..... 112/292; 112/300
[58] Field of Search ..... 112/184, 292, 295, 298, 112/300

[56] References Cited

U.S. PATENT DOCUMENTS 2,476,061 7/1949 Parry ..... 112/184
2,866,425 12/1958 Palmbach ..... 112/184 X
3,503,355 3/1970 Hagemeyer et al. ..... 112/292
4,138,958 2/1979 Papajewski ..... 112/292
4,181,088 1/1980 Kessler et al. ..... 112/292
4,365,568 12/1982 Ross ..... 112/295 X

*Primary Examiner*—Wm. Carter Reynolds
*Attorney, Agent, or Firm*—Sughrue, Mion, Zinn, Macpeak and Seas

[57] ABSTRACT

A thread cutter assembly in a sewing machine having a thread cutting cam which is driven by an opener shaft operated in response to the rotation of the rotary shaft of a rotary hook assembly. A movable edge is coupled to a cam follower engageable with the thread cutting cam. The engagement and disengagement of the cam follower and the thread cutting cam are controlled by a control mechanism to carry out a thread cutting operation.

21 Claims, 7 Drawing Figures

THREAD CUTTER ASSEMBLY IN SEWING MACHINE

BACKGROUND OF THE INVENTION

The present invention relates to a thread cutter assembly for a sewing machine. More particularly, the invention relates to an improved mechanism for mounting and driving a movable edge which is adapted to cut predetermined needle and bobbin threads in cooperation with a stationary edge.

Cutting off the needle thread and bobbin thread from pieces of cloth on which stitching has been completed is one of the important steps in a sewing operation. However, it is desirable to improve the cutting operation because it takes a relatively long time. Accordingly, a recent high-speed sewing machine has been provided with an automatic thread cutting mechanism. With this mechanism, the needle and bobbin threads are quickly and accurately cut off the pieces of sewn cloth in response to a thread cutting instruction which is issued, for instance, when the operator steps on a pedal. This mechanism contributes greatly to the high-speed sewing operation.

In a conventional automatic thread cutting type sewing machine, the relative movement of the stationary edge and the movable edge for cutting the threads is effected directly by the oscillating shaft of the sewing machine. Accordingly, the conventional sewing machine suffers from problems in that a large driving-power transmitting mechanism for driving the movable edge is required and hence the sewing machine is necessarily bulky and often is subject to breakdown.

In a two-needle sewing machine for carrying out sewing operations with two needles simultaneously, two thread cutting mechanisms provided respectively for the two needles are driven directly by the common oscillating shaft. Therefore, the characteristics and especially the thread cutting timing of the two thread cutting mechanisms cannot be adjusted separately. Thus, the two-needle sewing machine is disadvantageous in that a single thread cutting mechanism cannot satisfactorily cut the threads. In addition, since the thread cutting operations for the two needles are carried out by the common thread cutting drive mechanism, when the stitch pattern or length is adjusted, it is necessary to adjust the thread cutting mechanism also.

In the conventional thread cutter assembly of the sewing machine of this type, the thread cutting edges are either provided in a vertical plane so that they are parallel to the side of the bobbin carrying case where a bobbin thread pull-out hole is formed or they are provided in a horizontal plane perpendicular to the side of the bobbin carrying case. However, in the two-needle sewing machine capable of simultaneously carrying out sewing operations with two needles, rotary hook assemblies are so provided as to rotate in a horizontal plane and the bobbin thread extends towards the throat plate through the bobbin thread pull-out hole of the bobbin carrying case. Therefore, if the thread cutting edges are provided in a horizontal plane by the side of the bobbin carrying case, the angle formed between the bobbin thread and the thread cutting edges is necessarily small which tends to cause a problem that the thread cannot be cut with the thread cutting edges.

SUMMARY OF THE INVENTION

Accordingly, an object of the invention is to provide improved drive means for an automatic thread cutting type sewing machine.

In accordance with this and other objects of the invention, there is provided a sewing machine having a stationary edge provided fixedly at a thread cutting position, a movable edge which is reciprocated with respect to the stationary edge to cut a needle thread and a bobbin thread as desired when engaged with the stationary edge, a thread cutting cam which is driven in response to the rotation of a rotary shaft securing a rotary hook assembly, a thread cutting link mechanism having one end portion coupled to the movable edge and the other end portion on which a cam follower engageable with the thread cutting cam is provided wherein the thread cutting link mechanism drives the movable edge in response to the driving of the thread cutting cam, and engagement control means for controlling the engagement and disengagement of the thread cutting cam and the cam follower according to a thread cutting instruction so that an automatic thread cutting operation is carried out using an opener drive power whereby the movable edge is driven positively by a small, simple mechanism.

According to the invention, in a two-needle sewing machine, two thread cutting mechanisms are provided for the two needles, respectively, which carry out the thread cutting operations independently. Therefore, the stitch length and pattern of the two needles can be readily adjusted irrespective of the thread cutting mechanisms. In other words, since the thread cutting mechanism and the rotary hook mechanism are individually provided as units, the thread cutter assembly of the invention is advantageous in that the stitch length can be adjusted merely by moving the rotary hook bed. In adjusting the stitch, it is unnecessary to adjust the thread cutting mechanism mounted on the rotary hook bed.

Further according to the invention, especially in a two-needle sewing machine, the thread cutting mechanisms thereof are driven independently. Therefore, for each thread cutting mechanism, the thread cutting characteristic and especially the thread cutting timing can be adjusted. Thus, the thread cutting operations for the two needles can be carried out positively.

In the thread cutter assembly according to the invention, the stationary edge and the movable edges are provided slantingly with respect to a horizontal plane so that the ends of the edges closer to the rotary hook assembly are higher than the opposite ends thereof which lie in a vertical plane perpendicular to the direction of movement of the movable edge. Accordingly, the angle formed between the movable edge and the bobbin thread pulled slanting out of the bobbin carrying case towards the throat plate can be made large which makes it possible for the movable edge to catch the bobbin thread and the needle thread positively. Therefore, the movable edge can positively cut the threads when engaged with the stationary edge. Thus, the difficulty that the movable edge cannot catch the threads and accordingly the threads are not cut is eliminated with the use of the invention.

In the thread cutter assembly of the invention, the angle formed between the movable edge and the bobbin thread can be made larger as described above. Therefore, when compared with a conventional thread cutter assembly in which the distance between the bobbin carrying case and the movable edge is made long to increase the angle between the movable edge and the bobbin thread thereby to facilitate the bobbin thread catching of the movable edge, the corresponding mechanism of the thread cutter assembly of the invention can be made small. Accordingly, the thread cutter assembly of the invention is advantageous in that the distance between the bobbin carrying case and the throat plate can be made short which substantially eliminates the potential difficulty that the threads may be entangled as the bobbin thread is extended between the bobbin carrying case and the throat plate.

The nature, principle and utility of the invention will become more apparent from the following detailed description when read in conjunction with the accompanying drawings.

DESCRIPTION OF THE PREFERRED EMBODIMENTS

A preferred embodiment of the invention applied to a two-needle sewing machine is shown in FIGS. 1 through 7. These figures show only the mechanisms on the side of one of the two needles. The mechanism on the side of the other needle is arranged similarly but symmetrically with respect to the mechanism shown and therefore a detailed description thereof will be omitted.

Figure 1:
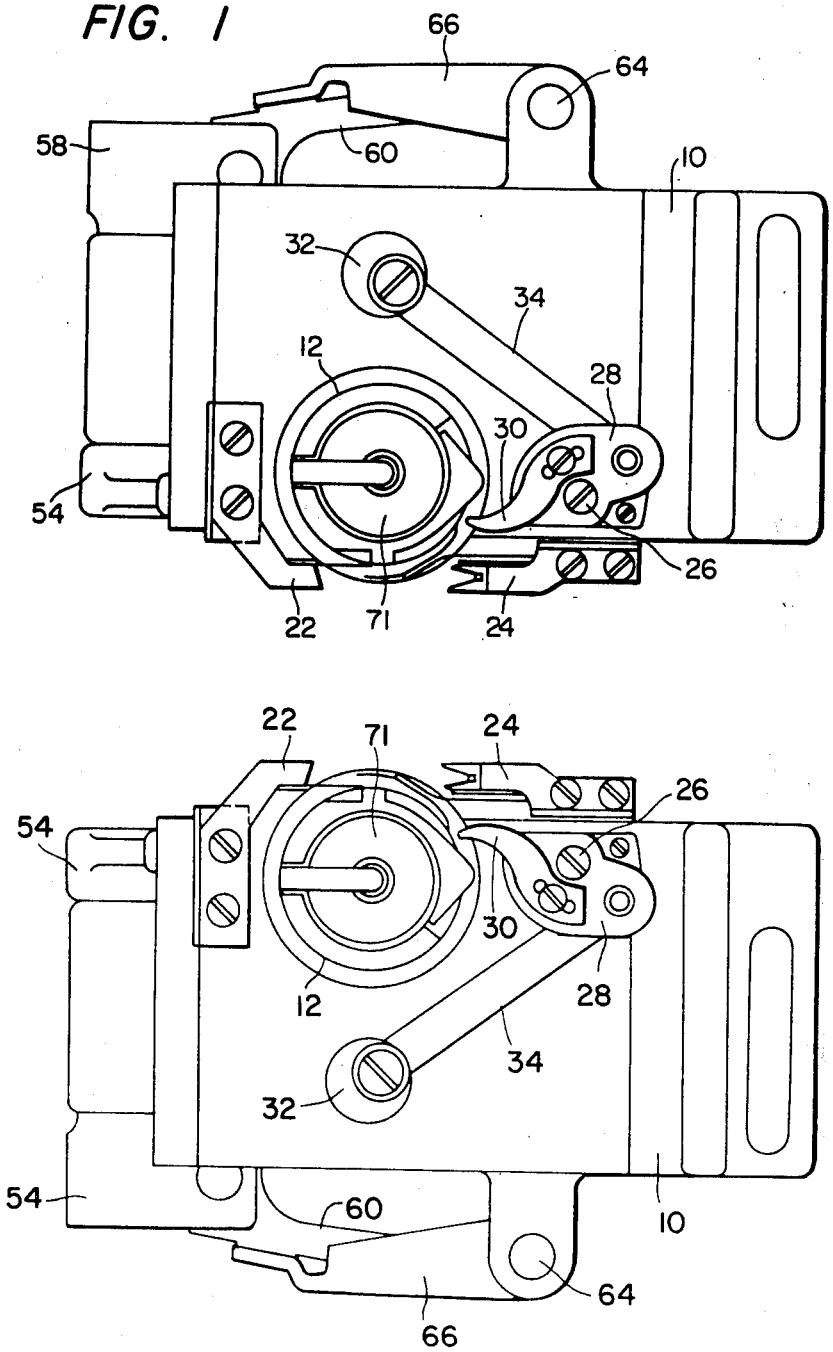
FIG. 1 is a plan view showing a mechanism on the side of one of the two needles of a two-needle sewing machine to which a thread cutter assembly according to the invention is applied.
Figure 3:
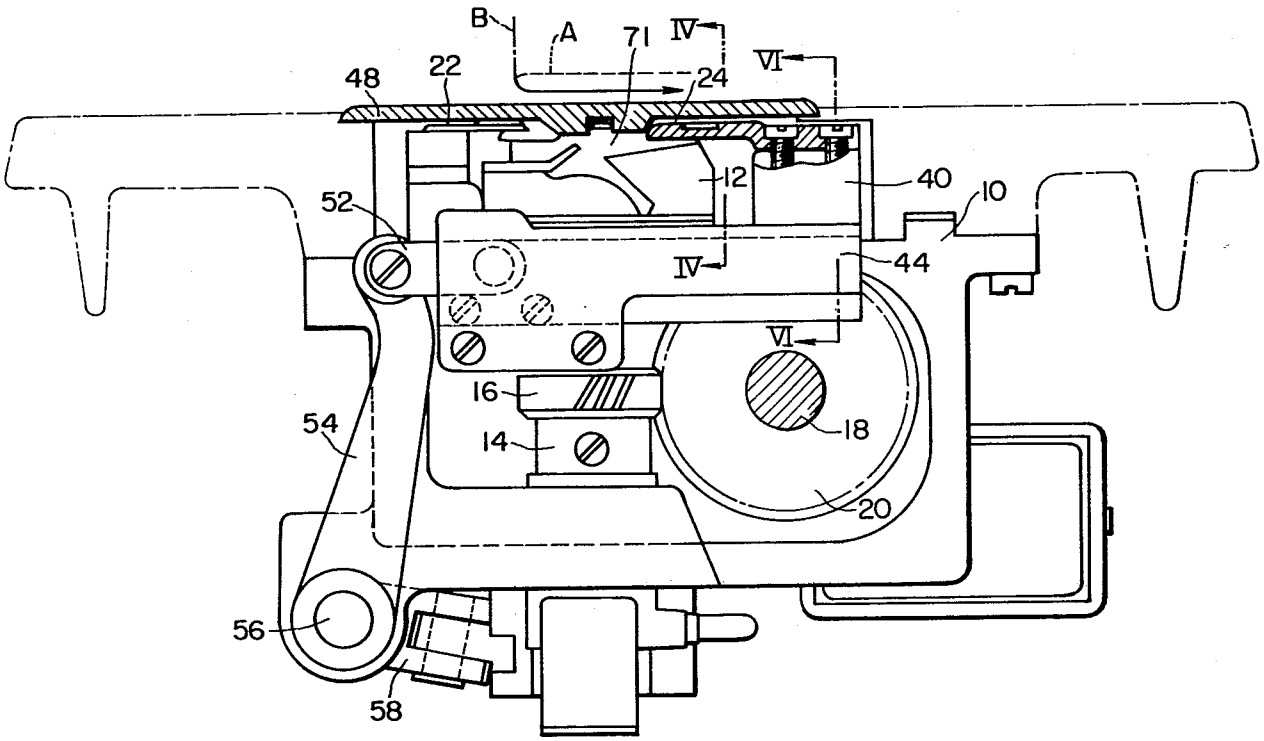
FIG. 3 is a side view of the mechanism shown in FIG. 1.

As shown in FIGS. 1 and 3, one rotary hook assembly 12 is rotatably supported on a rotary hook bed 10. The rotary hook assembly 12 is rotated as the needle is moved up and down so as to perform a sewing operation with the needle thread and the bobbin thread. A gear 16 is fixedly secured to the rotary shaft 14 of the rotary hook assembly 12. The gear 16 is engaged with a gear 20 secured to a lower shaft 18 so that the rotary hook assembly 12 is rotated in synchronization with the rotation of the lower shaft 18. That is, the rotary hook assembly 12 makes two revolutions for each vertical reciprocation of the needle.

A stationary edge 22 is fixedly secured near the needle aperture of the throat plate through which the needle and bobbin threads pass. A movable edge 24 is so arranged with respect to the stationary edge 22 that it can move straightly back and forth to thus form a thread cutter mechanism in which the threads are cut as desired when the two edges 22 and 24 are engaged with each other. The arrow A in FIG. 3 indicates the locus of movement of the movable edge 24. When the movable edge 24 is moved to the left-hand end B of the locus, the movable edge 24 is engaged with the stationary edge 22 thus cutting the threads.

Figure 4:
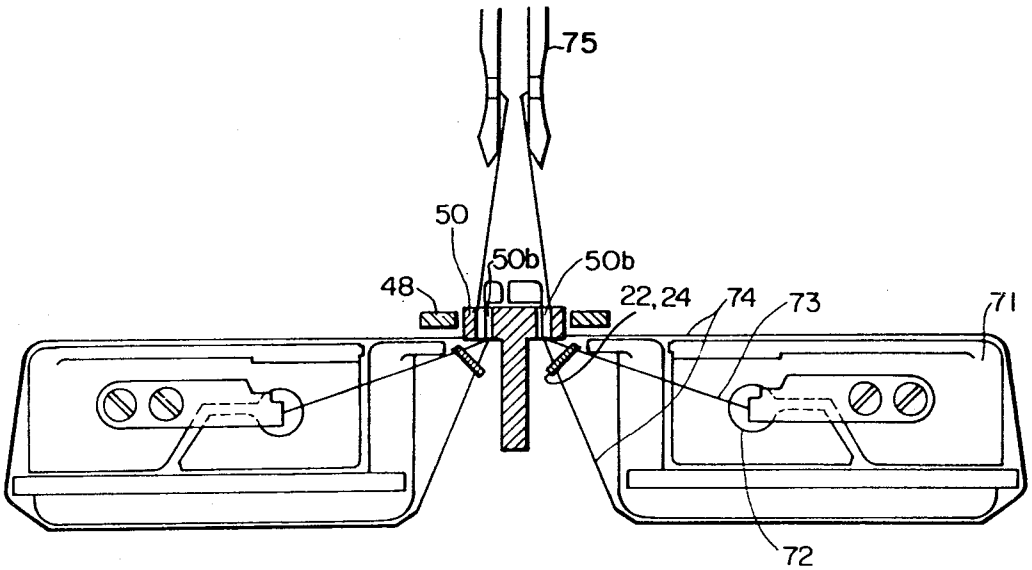
FIG. 4 is an enlarged sectional view taken along line IV—IV in FIG. 3 showing essential components.

As shown in FIG. 4, the stationary edge 22 and the movable edge 24 are disposed slantingly with respect to the horizontal plane so that the ends of the edges 22 and 24 closer to the rotary hook assembly 12 are higher than the opposite ends thereof. More specifically, in FIG. 4 showing a vertical section perpendicular to the direction of movement of the movable edge 24, the right-hand ends of the edges 22 and 24, as viewed in FIG. 4, are higher than the left-hand ends thereof so that both of the edges 22 and 24 cross at a sufficiently large angle the bobbin thread 72 and the needle thread 74 extend around the bobbin carrying case 71.

Figure 2:
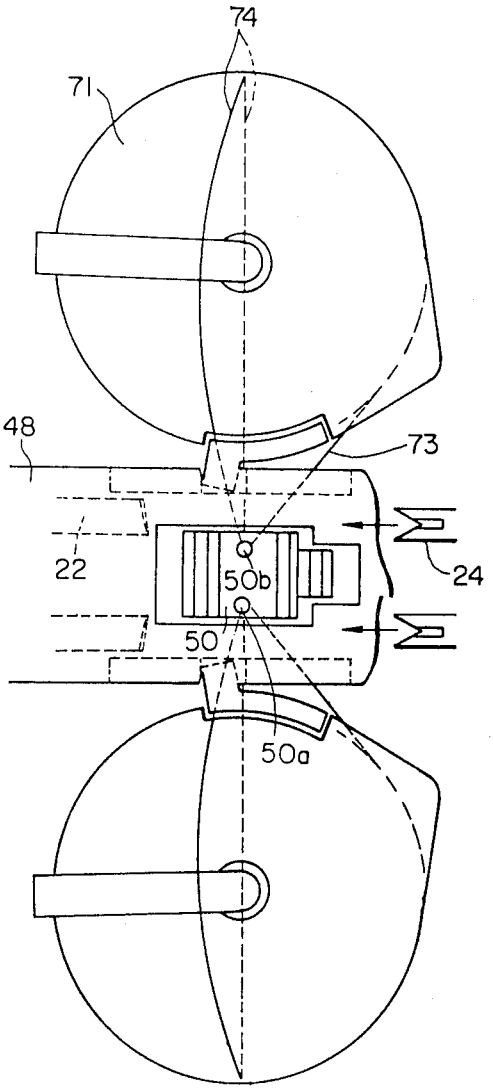
FIG. 2 is an enlarged plan view of a part of the mechanism of FIG. 1 showing the relation between the mechanism and the throat plate.

In FIGS. 2 through 4, reference numeral 71 designates the bobbin carrying case, 72 a bobbin thread pull-out hole, 73 the bobbin thread, 74 the needle thread, and 75 the needle.

As is seen in FIG. 1, an opener 30 is provided on the hook bed 10. The opener 30 is secured to an opener mounting plate 28 which is rotatably supported on a supporting shaft 26. The end of the opener 30 protrudes towards the hook assembly 12 at a predetermined time to temporarily open the hook assembly 12 thereby to form a gap through which the needle thread is conducted to the hook assembly 12. For this purpose, that is, in order to carry out the hook assembly opening operation, which is itself well known in the art, the opener 30 is driven by an opener shaft 32. That is, rotating power is transmitted to the opener mounting plate 28 through an opener driving lever 34 which is eccentrically coupled to the opener shaft 32 as a result of which the hook assembly opening operation is carried out once per two revolution of the hook assembly 12.

Figure 5:
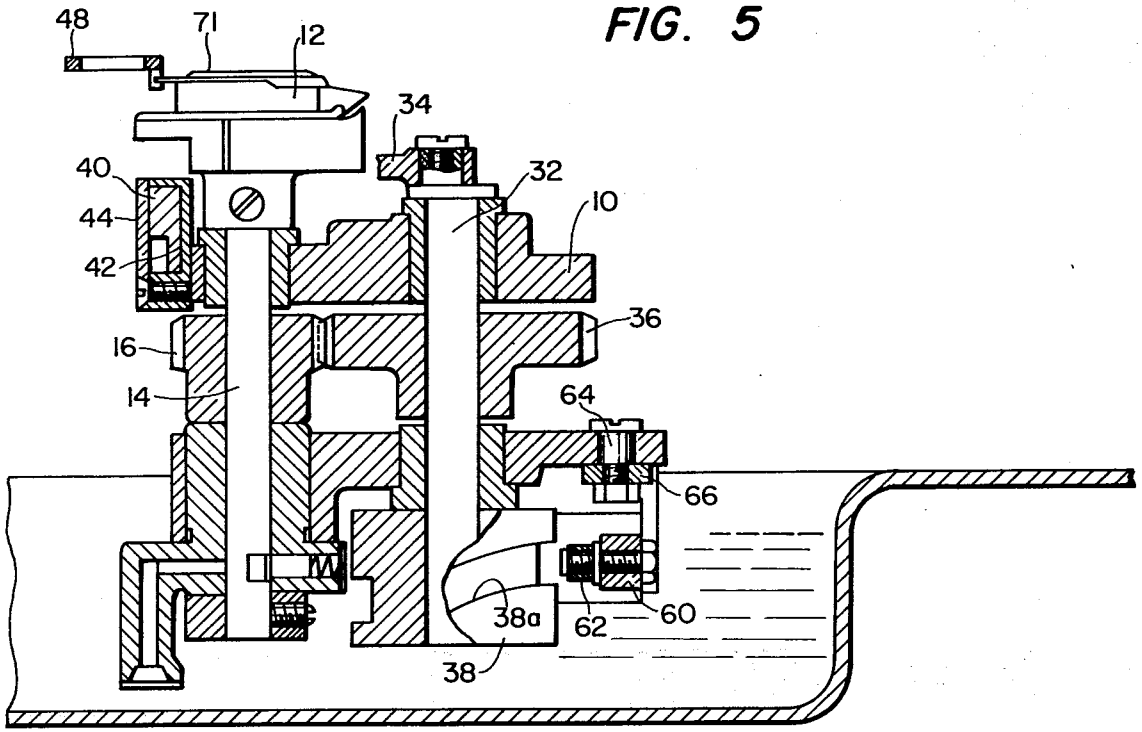
FIG. 5 is an enlarged sectional side view of the mechanism shown in FIG. 3.

The mechanism for driving the opener is shown in FIG. 5 in detail. The opener shaft 32 is rotatably supported on the hook bed 10. A gear 36 secured to the opener shaft 32 is engaged with the gear 16 of the rotary shaft 14 of the hook assembly 12 so that the opener shaft 32 is turned once per two revolutions of the hook assembly.

One of the specific features of the invention resides in that an automatic thread cutting operation is carried out by utilization of the opener driving power of the opener shaft 32. For this purpose, a thread cutting cam 38 is secured to the opener shaft 32 and a cam groove **38*a* is formed in the peripheral surface of the cam 38**. Another feature of the invention resides in that the stationary edge and the movable edge are disposed slantingly with respect to the horizontal plane so that the ends of the edges, closer to the hook assembly, are higher than the possible ends in a vertical plane perpendicular to the direction of movement of the movable edge.

According to the invention, the rotation of the thread cutting cam 38 is converted into straight movement of the movable edge 24 to cut the threads as desired. The arrangement of a thread cutting drive link mechanism for driving these elements will be described.

Figure 6:
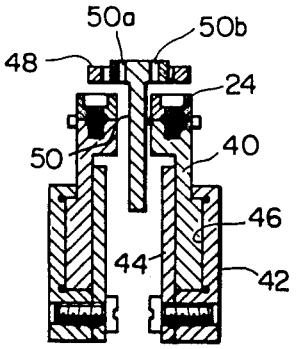
FIG. 6 is a sectional view taken along line VI—VI in FIG. 3.

The movable edge 24 is fixedly secured to a movable edge mounting plate 40 with screws. The movable edge mounting plate 40 is engaged with a guide groove 46 which is formed by a guide plate 42 fixed to the hook bed 10 and a retaining plate 44 secured to the guide plate 42 as shown in FIG. 6 in such a manner that the mounting plate 40 can slide perpendicularly to the surface of FIG. 6, i.e. horizontally (right and left) as viewed in FIG. 3. More specifically, the guide groove 46 is U-shaped in section and is formed in the guide plate 42. After the sliding part of the movable edge mounting plate 40 is inserted into the guide groove 46, the retaining plate 44 is secured to the guide plate 42 so that the movable edge mounting plate 40 can positively slide along the guide groove 46. As the movable edge 24 is fixedly mounted on the movable edge mounting plate 40 which extends to near the thread cutting position, the length of the movable edge 24 can be made relatively short, and accordingly an unsatisfactory cutting operation carried by bending of the movable edge 24 or the like can never occur. The movable edge mounting plate 40 is slidably held only by the retaining plate 44 which is secured to the guide plate 42 with screws so that maintenance and inspection or replacement thereof can be readily achieved.

As seen in FIG. 6, the movable edge 24 is provided near a feed dog 50 which feeds a piece of cloth along the throat plate 48. In the above-described two-needle sewing machine, two needle holes 50*a* and 50*b* are cut in the feed dog 50. One end portion of the thread cutting drive link mechanism is coupled to the movable edge 24. That is, in this embodiment, one end of a coupling link 52 is pivotally secured to the movable edge mounting plate 40 while the other end is also pivotally connected to an arm 54. One end of the arm 54 is fixedly secured to a shaft 56 which is pivotally mounted on the hook bed 10 while the other end is secured to a rocker arm 58.

Figure 7:
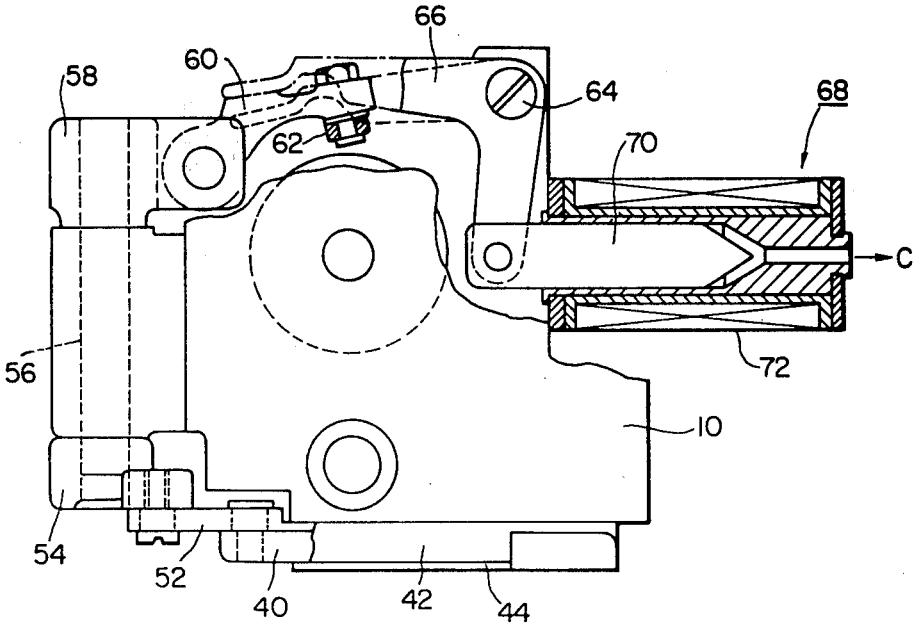
FIG. 7 is a plan view of the mechanism in FIG. 1 from which the rotary hook assembly has been removed.

As shown in FIG. 7, a movable follower arm 60 is rockably supported by the end of the rocker arm 58 and a roller cam follower 62 engageable with the above-described thread cutting cam 38 is provided on the end of the movable follower arm 60. The movable follower arm 60 is urged, such as a spring (not shown), so that the roller cam follower 62 is held away from the cam groove 38*a* of the thread cutting cam 38. Accordingly, in the normal state, even when the opener shaft 32 is turned, the thread cutting cam 38 is never engaged with the roller cam follower and the movable edge 24 is maintained in a thread cutting standby state as shown in FIGS. 1 through 3.

The thread cutting drive link mechanism couples the thread cutting cam 38 to the movable edge as described above. The thread cutting drive link mechanism is provided with an engagement control mechanism with which the engagement and disengagement of the thread cutting cam 38 and the roller cam follower 62 are controlled by a thread cutting instruction. In the preferred embodiment described, the engagement control mechanism includes a bell crank 66 which is pivotally mounted on a supporting shaft 64. One end of the bell crank 66 abuts against the movable follower arm 60 while the other end is pivotally coupled to the movable iron core 70 of an electromagnetic solenoid 68. When an exciting current is applied to the exciting coil 72 of the electromagnetic solenoid 68, the movable iron core 70 is moved in the direction of the arrow C in FIG. 7. As a result, the bell crank 66 is turned counterclockwise to turn the movable follower arm 60 clockwise and to thereby cause the roller cam follower 62 to engage with the cam groove 38*a* of the thread cutting cam 38. Thus, the movable edge 24 is coupled to the thread cutting cam 38 by the thread cutting drive link mechanism so as to perform the automatic thread cutting operation as desired at the designated or operator controlled time.

In the automatic thread cutting operation, the drive power of the opener shaft is utilized for moving the movable edge back and forth parallel to the throat plate. Accordingly, the thread cutter assembly according to the invention is simpler in construction, lighter in weight and smaller in size than a conventional cutter assembly in which the movable edge driving power is obtained from the oscillating shaft.

As described above, when the sewing operation has been accomplished, the electromagnetic solenoid 68 is excited by stepping on a pedal or by a thread cutting instruction signal from an automatic sewing mode selector. As a result, the cam follower 62 is coupled to the thread cutting cam 38 to transmit the drive power of the opener shaft 32 through the thread cutting drive link mechanism to the movable edge 24. Accordingly, the movable edge 24 is reciprocated along the direction of the arrow A in FIG. 3. More specifically, the movable edge 24 cuts the needle thread and the bobbin thread at the thread cutting position B and then returns to the original standby position. Under this condition, the electromagnetic solenoid 68 is deenergized as a result of which the cam follower 62 is disengaged from the thread cutting cam 38. At this point, the thread cutting operation has been accomplished.

In the above-described embodiment, the operating members of the engagement control mechanism include the exciting coil 72 and the movable iron core 70. However, the control mechanism is not limited thereto or thereby.

Furthermore, in the above-described embodiment, the thread cutting cam 38 is described as being driven through the opener shaft 32 although the thread cutter assembly may be so designed that the thread cutting cam 38 is fixedly secured to the hook assembly securing rotary shaft to allow the rotary shaft to directly drive the thread cutting cam.

While a preferred embodiment of the invention has been described, it is believed apparent to those skilled in the art that various changes and modification made be made thereto without departing from the spirit and scope of the invention.

What is claimed is:

1. A thread cutter mechanism for a two-needle sewing machine comprising first and second cutter assemblies, one of said cutter assemblies being disposed on each side of a feed dog of said sewing machine, each of said assemblies comprising:

a movable edge reciprocably mounted with respect to said stationary edge for cutting a needle thread and a bobbin thread when engaged with said stationary edge, said movable edge and said stationary edge being mounted slantingly with respect to a horizontal plane so that first ends of said stationary edge and said movable edge are higher than second ends thereof in a vertical section perpendicular to the direction of movement of said movable edge;

a rotary hook assembly;

a thread cutting cam coupled to be driven in response to rotation of a rotary shaft securing said rotary hook assembly, said rotary shaft being adapted to drive said rotary hook assembly;

a thread cutting link mechanism comprising a movable edge mounting plate to which said movable edge is fixedly secured, a guide for supporting and guiding said movable edge mounting plate in a plane parallel to a direction of movement of a feed dog of said sewing machine and with said movable edge disposed between said feed dog and said movable edge mounting plate, and an end portion on which a cam follower engageable with said thread cutting cam is provided, said thread cutting link mechanism being operatively coupled for driving said movable edge in response to movement of said thread cutting cam; and engagement control means for controlling the engagement and disengagement of said thread cutting cam and said cam follower according to a thread cutting instruction.

2. The thread cutter assembly as claimed in claim 1 in which said thread cutting cam is driven by an opener shaft adapted to perform a rotary hook assembly opening operation in response to rotation of said rotary shaft.

3. The thread cutter assembly as claimed in claim 1 in which said thread cutting link mechanism further comprises:

power transmitting means for transmitting to said movable edge mounting plate drive power which is generated when said cam follower follows said thread cutting cam.

4. The thread cutter assembly as claimed in claim 2 in which said opener shaft has a gear secured fixedly thereto, said gear engaging with a gear coupled to said rotary shaft.

5. The thread cutter assembly as claimed in claim 3 in which said power transmitting means comprises:

a movable follower arm on which a roller cam follower is mounted;

a rocker arm upon which said movable follower is pivotally supported;

a shaft which is integrally coupled to said rocker arm;

an arm fixedly secured to said shaft; and a link coupling said arm to said movable edge mounting plate.

6. The thread cutter assembly as claimed in claim 2 further comprising an opener, an opener driving lever and an opener mounting plate, said opener being driven by said opener shaft through said opener driving lever, said opener driving lever having a first end portion coupled eccentrically to said opener shaft and a second end portion coupled to said opener mounting plate, said opener being mounted on said opener mounting plate.

7. The thread cutter assembly as claimed in claim 6 in which said engagement control means comprises:

an operating mechanism operating in response to an instruction signal; and a bell crank driving said movable follower arm in response to the operation of said operating mechanism.

8. The thread cutter assembly as claimed in claim 7 in which said operating mechanism comprises:

an exciting coil which is excited by said instruction signal; and a movable iron core for turning said bell crank in response to excitation of said exciting coil.

9. The thread cutter assembly as claimed in claim 8 in which said cam follower is controlled by said engagement control means to engage with and disengage from a cam groove formed in said thread cutting cam.

10. The thread cutter assembly as claimed in claim 9 in which said movable edge mounting plate extends to a position near a thread cutting position.

11. A thread cutter assembly for a sewing machine comprising:

a stationary edge, a bobbin carrying case, a throat plate and a rotary hook assembly, said stationary edge protruding horizontally at a position through which pass both a bobbin thread which is pulled out of a bobbin thread pull-out hole in a side of said bobbin carrying case and a needle thread which, after being laid around said bobbin carrying case, extends to said throat plate, said bobbin carrying case being supported on said rotary hook assembly;

a movable edge reciprocably mounted horizontally with respect to said stationary edge for cutting said needle and bobbin threads when engaged with said stationary edge, said stationary edge and said movable edge being mounted slantingly with respect to a horizontal plane so that first ends of said stationary edge and movable edge are higher than second ends thereof in a vertical section perpendicular to the direction of movement of said movable edge;

a thread cutting cam coupled to be driven in response to rotation of a rotary shaft securing said rotary hook assembly;

a thread cutting link mechanism having a first end portion coupled to said movable edge and a second end portion on which a cam follower engageable with said thread cutting cam is provided, said thread cutting link mechanism driving said movable edge in response to movement of said thread cutting cam; and engagement control means for controlling the engagement and disengagement of said thread cutting cam and said cam follower according to a thread cutting instruction.

12. The thread cutter assembly as claimed in claim 11 wherein said sewing machine is a two-needle sewing machine and wherein two said rotary hook assemblies are provided on a rotary hook assembly mounting bed respectively for two needles of said sewing machine, one said stationary edge, one said movable edge, one said thread cutting cam, one said thread cutting link mechanism and one said engagement control means being provided on said rotary hook assembly mounting bed for each of said two needles.

13. The thread cutter assembly as claimed in claim 11 in which said thread cutting cam is driven by an opener shaft adapted to perform a rotary hook assembly opening operation in response to rotation of said rotary shaft.

14. The thread cutter assembly as claimed in claim 11 in which said thread cutting link mechanism comprises:

a movable edge mounting plate to which said movable edge is fixedly secured;

a guide which supports and guides said movable edge mounting plate; and power transmitting means for transmitting to said movable edge mounting plate drive power which is generated when said cam follower follows said thread cutting cam.

15. The thread cutter assembly as claimed in claim 13 in which said opener shaft has a gear secured fixedly thereto, said gear engaging with a gear coupled to said rotary shaft.

16. The thread cutter assembly as claimed in claim 14 in which said power transmitting means comprises:

a movable follower arm on which a roller cam follower is mounted;

a rocker arm upon which said movable follower is pivotally supported;

a shaft which is integrally coupled to said rocker arm;

an arm fixedly secured to said shaft; and a link coupling said arm to said movable edge mounting plate.

17. The thread cutter assembly as claimed in claim 15 further comprising an opener, an opener driving lever and an opener mounting plate, said opener being driven by said opener shaft through said opener driving lever, said opener driving lever having a first end portion coupled eccentrically to said opener shaft and a second end portion coupled to said opener mounting plate, said opener being mounted on said opener mounting plate.

18. The thread cutter assembly as claimed in claim 17 in which said engagement control means comprises:

an operating mechanism operating in response to an instruction signal; and a bell crank driving said movable follower arm in response to the operation of said operating mechanism.

19. The thread cutter assembly as claimed in claim 18 in which said operating mechanism comprises :

an exciting coil which is excited by said instruction signal; and a movable iron core for turning said bell crank in response to excitation of said exciting coil.

20. The thread cutter assembly as claimed in claim 19 in which said cam follower is controlled by said engagement control means to engage with and disengage from a cam groove formed in said thread cutting cam.

21. The thread cutter assembly as claimed in claim 20 in which said movable edge mounting plate extends to a position near a thread cutting position.

* * * * *